US005172871A

United States Patent [19]

Schütt et al.

[11] Patent Number: 5,172,871

[45] Date of Patent: Dec. 22, 1992

[54] APPARATUS FOR GUIDING A WEB OF MATERIAL ACROSS A DRIVEN DRUM

[75] Inventors: Eduard C. Schütt, Hamburg; Peter Hübner, Wedel; Kaj Sellschopp, Rosengarten, all of Fed. Rep. of Germany

[73] Assignee: Aristo Graphic Systeme GmbH KG, Hamburg, Fed. Rep. of Germany

[21] Appl. No.: 649,734

[22] Filed: Feb. 1, 1991

[30] Foreign Application Priority Data

Feb. 1, 1990 [DE] Fed. Rep. of Germany ..... 4002894
Sep. 5, 1990 [DE] Fed. Rep. of Germany ..... 4028536

[51] Int. Cl.[5] ..... B65H 18/02; B65H 18/22; B65H 20/02; B65H 20/06

[52] U.S. Cl. ..... 242/67.10 R; 242/67.2; 242/68.7; 242/78.7; 242/DIG. 3

[58] Field of Search ..... 242/67.1 R, 67.3 R, 242/66, DIG. 3, 67.2, 68.7, 78.7

[56] References Cited

U.S. PATENT DOCUMENTS

| | | | |
|---|---|---|---|
| 3,501,106 | 3/1970 | Case | 242/67.1 R |
| 3,671,033 | 6/1972 | Coast | 242/67.1 R |
| 3,792,825 | 2/1974 | Kampf | 242/67.3 R |
| 3,857,525 | 12/1974 | Gerber et al. | 242/67.3 R |
| 4,160,528 | 7/1979 | Malone, Sr. et al. | 242/56 R |
| 4,784,345 | 11/1988 | Romanowski et al. | 242/DIG. 3 |
| 4,823,147 | 4/1989 | Charropin | 242/67.3 R |
| 4,838,497 | 6/1989 | Kramer et al. | 242/67.2 |

FOREIGN PATENT DOCUMENTS

| | | |
|---|---|---|
| 3240910 | 8/1983 | Fed. Rep. of Germany . |
| 283339 | 9/1988 | France . |
| 1439858 | 6/1976 | United Kingdom . |

*Primary Examiner*—Daniel P. Stodola
*Assistant Examiner*—John Q. Nguyen
*Attorney, Agent, or Firm*—Fitzpatrick, Cella, Harper & Scinto

[57] ABSTRACT

A fixture for aligning or working of a material web (10) which is fed from a storage area across a driven drum (11) forming a processing surface has a receiving arrangement (30) for the web material placed lower than the drum (11). The receiving arrangement (30) forms a support area extending parallel to the drum (11), which has at least one surface moving vertically in relation to the axis of rotation (11') of the drum (11) and makes contact with the part of the material web (10) rolling off the drum (11) so as to take the web along. In the direction of movement, a stationary deflection surface (32) is disposed at a distance above the point where the material web (10) meets the support area.

7 Claims, 6 Drawing Sheets

APPARATUS FOR GUIDING A WEB OF MATERIAL ACROSS A DRIVEN DRUM

BACKGROUND OF THE INVENTION

1. Field of Invention

The invention relates to a fixture for aligning or working a web of material which is fed from a storage area across a driven drum forming a processing surface and which from there reaches a receiving arrangement which is placed lower than the drum.

2. Brief description of the prior art

In a known device of this type (German Published, Patent Application DE-OS 32 40 910), processing of a web material takes the form of a printing operation, performed by a print head which can be moved back and forth parallel to the axis of rotation of the drum. In this case the web material to be processed reaches the drum from a supply roller, which constitutes a storage area. From the supply roller, the web material is fed via a loop area and a guide roller to a take-up roller, which constitutes a receiving arrangement. In this known device the drum as well as the supply roller and the take-up roller are driven. Driving of the rollers and drum is required to roll off more or less web material from the supply roller, depending on the size of the loop of material web between the supply roller and the drum, and is determined by a sensor. Driving the rollers also will wind on the take-up roller more or less web material, depending on the size of the loop of material web between drum and take up-roller. In either case it must be assured that there a sufficiently large loop on both sides of the drum, so that there is always sufficient web material is available during different directions of drum rotation in the course of the printing operation. Therefore, the known device is structurally complicated, because it not only requires a driven supply roller and a driven take-up roller, but also additional control devices for the roll-off and wind-up operations.

It should also be mentioned a device of the known type is not only used to print a material web in the fashion of a drum-type plotter. For example, it is possible to use a cutting head in place of a printing head for cutting foil material which is in the shape of a web, such as material where the plastic foil portion has been provided with a layer of adhesive which in turn is covered with a removable material layer. It is possible to cut out areas from the plastic foil by cutting down to the protective layer, in order to make stick-on signs or displays.

OBJECT AND SUMMARY OF THE INVENTION

The object of the invention is to provide a fixture with a very simply constructed receiving arrangement for aligning or working of a web of material.

This object is attained by improving a device of the previously mentioned type in accordance with the invention in such a way that the receiving arrangement forms a support area that extends parallel to the drum. This support area has at least one surface moving vertically to the axis of rotation of the drum, so that moving surface will come into contact with a portion of the web rolling off the drum and take the web along. In the direction of movement, a stationary deflection surface is disposed at a distance above the point where the material web meets the support area.

In this way, the receiving arrangement of a fixture according to the invention is not formed by a controllably driven take-up roller, as in the known device. Instead, under the force of gravity the material web rolling off the drum comes into contact with a support area that has a movable surface. Because of friction between the support surface and the material web, this surface takes the material web along. Hence, the web comes into contact with a stationary deflection surface, which reverses the material web above the moving surface. Thus, the material web is wound without the winding taking place around a solid core.

If the material web is moved against the actual forward movement by a change of the rotation of the drum in the course of the aligning or working operations, so that an area of the web material which has already rolled off the drum is returned towards it, the web material is simply pulled back in the direction of the drum. This pulling back is against the force of gravity and the friction between the web material and the moving surface. This may result in a portion of the wound material in the receiving arrangement being unwound again. However, no special drive in the receiving arrangement is required for unwinding. Unwinding is accomplished by means of the web material being pulled back against a friction effect between the moving surface of the receiving arrangement, and the material web.

It should be mentioned that the winding up of the material web referred to above in the direction of the receiving arrangement requires the web material to have a certain amount of inherent stiffness, such as, for example, thin cardboard for printing or a multi-layered foil of the type mentioned above. This is so that actual winding up can take place when the material web is displaced by the moving surface that has taken it along, instead of the web material simply collapsing. The requirements for the inherent stiffness of the web material depend on the actual type of intended use and can be simply determined by testing. Finally, the winding process is made easier if the web material had been rolled up prior to processing or working, because then a certain deformation in the direction of winding is normally present.

To achieve a particularly simple construction of a fixture in accordance with the invention, the support area can be provided below the roll-off side of the drum, so that the material web reaches the support area vertically, and directly from the drum.

In a preferred embodiment of the invention the moving surface of the support area is formed by the upper stringer of an endless belt made, for example, of rubber with a roughened surface. The belt extends slackly in a loop as an upper stringer portion between a non-driven roller and a drive roller. The non-driven roller is located at the front end of the stringer, looking in the direction of movement of the endless belt. The engagement between drive roller and belt is free of relative displacement of the two in relation to each other. In this construction the surface of the support area taking the material web along is formed by an upper stringer portion of a revolving belt which is in engagement with a drive roller at its back end, looking in the direction of movement. There is no relative movement between the stringer and the belt, so that the upper stringer is moved in a defined manner and its sagging loop does not change during operation. Also, the curvature of the upper stringer generated by the loop assists in the winding process of the material web.

To achieve a particularly smooth winding operation, it is possible to provide in the device of the invention in the end areas of each of the non-driven roller and drive roller a circular disk disposed between them. The circular disk has an axis of rotation extending parallel to the axis of rotation of the drive roller and is located in a vertical central plane between the non-driven roller and the drive roller. The circular disk is in engagement with the upper surface of more than one-half of the upper stringer of the endless belt.

Because of the provision of such circular disks, the larger portion of the upper stringer of the endless belt, and thus the support area receiving the material web, take on the shape of an arc of a circle. This smooth shape, maintained during operation with the aid of the circular disks, improves the winding process. In such a structure the circular disks preferably are of such a size that they are in contact with the upper stringer of the endless belt at least as far as the height of the lower edge of the roller or the drive roller. In this way the circular disks practically maintain that portion of the endless belt which acts as a support area, in a curved shape in the form of an arc of a circle. Hence, the appropriate circular disk can press the upper stringer of the endless belt into engagement with the drive roller or the non-driven roller at least along the horizontal central planes of the disk and upper stringer.

To maintain the curved shape of the upper stringer of the endless belt under all operational conditions and to prevent further displacement or distortions caused either by irregularities in the structure of the belt or forward movements of the belt, an endless guideway in the central plane of each circular disk on the surface of the belt facing away from the disk can be provided. This guideway is in engagement with adapted guideways of the non-driven and drive rollers. The guideway of the belt preferably consists of a V-belt-like rib, with cutouts spaced uniformly along its free edge.

The winding process is enhanced if the non-driven roller is placed higher than the drive roller. In this case, the web material is lifted together with the upper stringer, at least when approaching the non-driven roller, and thereby a force component in the direction of winding becomes active. To control the course of the belt exactly, an additional freewheeling roller is provided for the lower stringer of the belt, between the non-driven roller and drive roller, so that the belt is guided in a defined circulation. In this case, the axis of rotation of the additional freewheeling roller may be located in a vertical plane located centrally between the two vertical planes containing the axes of rotation of the drive roller and the non-driven roller.

It also may be advantageous to provide the non-driven roller with a braking force. In this way the upper stringer of the belt located between it and the driver roller is slightly "buckled" and a loop is assured, while the lower stringer is tightened around the additional freewheeling roller.

It has been shown that suitable looping of the belt is achieved if the length of the belt is between 10% to 25%, and preferably between 10% and 15%, greater in length than the shortest circumference measured around the roller arrangement.

In the course of the forming a moving surface by the upper stringer of an endless belt, it is possible to attach a deflection plate adjacent to the non-driven roller. The deflection plate forms a deflection surface and is concavely curved from the side of the upper stringer. The web material transported by the upper stringer is fed in the direction of the deflection surface and is deflected in such a way that a winding process is initiated and carried out.

The invention now will be described in further detail, by means of the drawings which illustrate an exemplary embodiment.

DETAILED DESCRIPTION OF THE PREFERRED EMBODIMENTS

Figure 1:
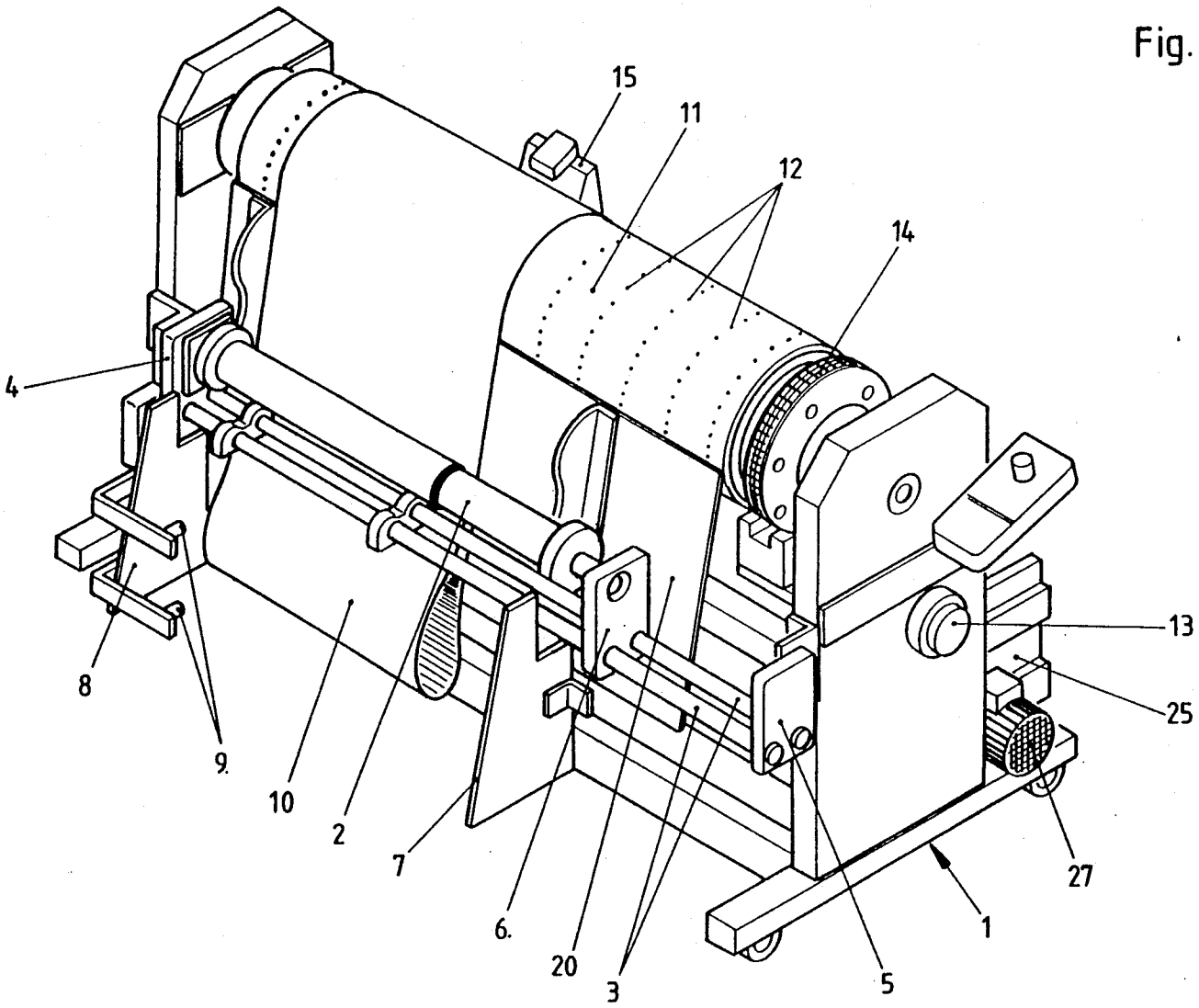
FIG. 1 is a perspective elevation view of a fixture seen from a side of a drum plotter having a web storage area.
Figure 2:
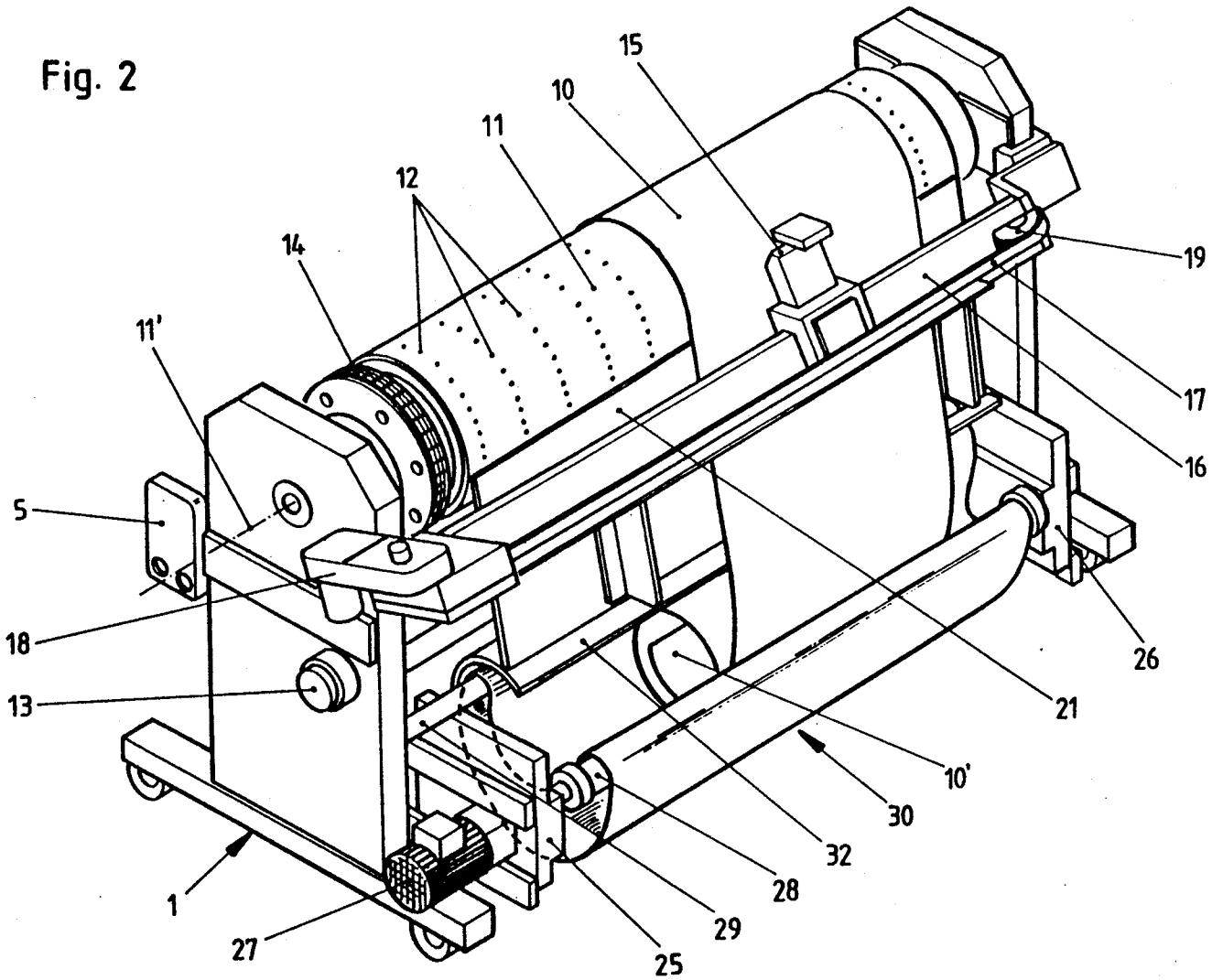
FIG. 2 is a perspective elevation view of the fixture of FIG. 1, seen from the side of a drum plotter having a web receiving arrangement.

A fixture embodiment in accordance with FIGS. 1 and 2 has a frame 1 disposed on rollers. A drum 11 is seated between vertical cheeks of a frame in the upper area so that the drum can rotate around its longitudinal axis 11'. On one end of the drum 11 is a disk 14 in the shape of a toothed wheel, connected in a conventional manner (not shown) with the rotor shaft of a drive motor 13. The toothed wheel is controlled so that the wheel can turn in either direction. Suction openings 12 are provided in the wall of the drum 11, through which underpresure can be applied from the inside also in a known manner. With the help of underpressure the material web to be processed is held on the surface of the drum 11 and moves together with the drum The material web 10 is rolled off a supply drum 2 (FIG. 1) which is located in a storage area and is fastened by means of pillow blocks 4, 6 on support rails 3, which extend parallel to the axis of rotation 11' of the drum 11. One side of these support rails 3 is fastened on the pillow block 4 and the other side is on an additional pillow block 5 that is fastened on a cheek of the frame 1. The supply roller 2 is driven in a controlled manner that is conventional for such devices (not shown), so as to always supply a sufficient amount of web material. The web material forms a loop between the supply roller 2 and the drum 11 in the manner indicated in FIG. 1. This loop is monitored with the aid of sensors 9 in such a way that the drive of the supply roller 2 is interrupted when the loop becomes too large and is started again to supply more web material if the loop is too small. Lateral protection plates 7, 8 are provided on the side of the frame 1 with the supply roller 2. Of these protection plates, the protection plate 7 is laterally displaceable to accommodate the size of the installed supply roller 2. In addition, a guide plate 20 is provided between the supply roller 2 and the drum 11. This guide plate essentially is maintained in the frame 1 so as to be tangent to the drum 11. The material web 10 slides over the guide plate and, onto the drum 11. The guide plate 20 defines the exact transition of the web material to the drum 11. Only web material located above the upper edge of the guide plate 20 is drawn against the surface of the drum 11 by the underpressure present at the openings 12. Web material located in the area of the guide plate 20 is freely movable.

A guide rail 16 is fastened to the frame 1 on the side of the drum 11 facing away from the supply roller 2. The guide rail extends parallel to the axis of rotation 11' of the drum 11, and the tool head 15 is maintained on the guide rail so the tool head can move back and forth. In a known manner the tool head 15 can support a cutting tool or a drawing pen. The tool head also can be moved, in a known manner, between a position where the cutting tool or writing pen is in contact with the material web and a position where there is no contact with the material web 10. This position change also can be achieved, in a known manner, by appropriate movements of the cutting tool or the writing pen.

A toothed belt 17 is fastened to the tool head 15 for the purpose of moving the tool head along the guide rail 16. On one end of the guide rail 16 the toothed belt runs over a toothed wheel 19 and on the other end it is connected with a drive motor 18. In this way the tool head 15 can be moved back and forth by means of the controlled drive of the motor 18 along the guide rail 16 in a way required for processing or working the material web 10.

A guide plate 21 is fastened on the frame 1 between the guide rail 16 and the drum 11. The disposition of the guide plate 21 and its function, correspond to those of the already described guide plate 20, on an opposite side of the drum.

A receiving arrangement located below the drum 11 and below the guide rail 16 essentially is formed by an endless belt 30 consisting of rubber with a roughened surface. To support the endless belt 30, a freely rotatable freewheeling roller 29, fixed between the cheeks of the frame 1, and a drive roller 28, continuously driven by a motor 27, is fixed to block 25 and rotatably is seated between the blocks 25 and 26 which are fastened to the frame 1. A freely rotating, additional freewheeling roller 31, also seated between the blocks 25 and 26, is located below the drive roller 28 and the freewheeling roller 29 in a vertical plane. This vertical plane is equidistant from the vertical plane through the axis of rotation of the drive roller 28 and the vertical plane through the axis of rotation of the freewheeling roller 29.

The endless belt 30 is of a length which is 10% to 15% greater than the shortest circumference around the rollers 28, 29, 31. In an exemplary embodiment the minimum circumference around the rollers is 1,180 mm, while the belt has a length of 1,330 mm. A loop results because of the larger size of the belt 30. As particularly illustrated in FIG. 3, the upper stringer 30' of the belt 30 forms a trough-shaped depression. The depression rises further upwards on a side of a freewheeling roller 29, that is placed higher than a drive roller 28. The depression is lower than on the side adjacent to the drive roller 28. The lower stringer 30'' of the belt 30 runs over the bottom side of the additional freewheeling roller 31.

The drive roller 28 engages the belt 30 in such a way that there is no relative movement there between, during operation. Hence, either the friction coefficient between the drive roller 28 and the belt 30 is sufficiently large or an additional pressure roller, (not shown), is used. The drive roller 28 turns the belt 30 in the direction indicated by an arrow in FIG. 3, so that a location on the upper stringer 30' of the belt 30 is displaced from the drive roller 28 in the direction of the freewheeling roller 29. The loop of the upper stringer 30' remains constant in the course of this movement.

As can be seen in FIG. 2, the upper stringer 30' is located below the drum 11 in such a way, that the web material rolling off the drum 11 comes into contact under the force of gravity with an area of the upper stringer 30' adjacent to the drive roller 28. Because of this contact the web material is taken along in a direction towards the freewheeling roller 29. It should again be mentioned in this connection that the web material to be aligned or worked has a certain amount of inherent stiffness. The material also usually is pre-bent because it previously was rolled up on the supply roller 2 and was run over the curved surface of the drum 11. Therefore, the web material does not collapse onto the stringer 30', but is already pre-bent in the direction of movement of the upper stringer 30' of the belt 30.

A carrying along of the web material by the upper stringer 30' of the belt 30 results in a winding movement of the web material. The winding movement is caused by the unavoidable slipping back of the web material on this rising portion of the upper stringer 30' and of a continuing force component, in the direction of the rising portion of the upper stringer 30' that acts on the web material. The web material, therefore, slowly is wound up, depending on the amount of web material rolling off the drum 11, as indicated in FIG. 2. This wind-up movement is assisted by the fact that a deflection plate 32 fastened on the frame 1, is next to the freewheeling roller 29. This deflection plate, as seen from the direction of the upper stringer 30', is concavely curved. The deflection plate curvature forms a sort of extension of the upper curvature of the stringer 30' and also corresponds to the curvature of the rolled-up web material.

Thus, a rolled-up section 10' (FIG. 2) of the material web 10 is created with the aid of the endless belt 30, without an inserted core. Particularly during a rotation of the drum 11 which results in a pull-back of web material that already has passed over the drum, the rolled-up material easily can unwind. Thus, it is not necessary to provide a loop of web material between the drum 11 and the belt 30.

Figure 3:
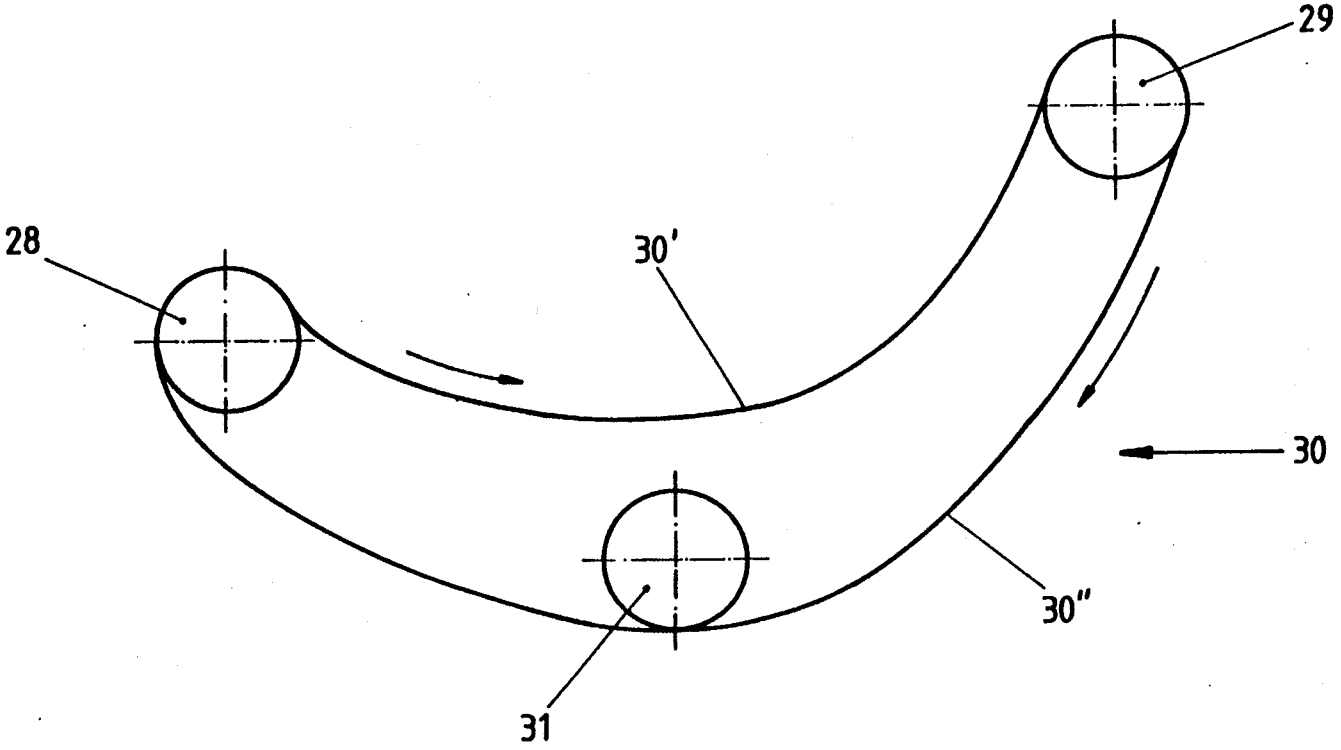
FIG. 3 schematically shows a disposition of belt in a fixture according to FIGS. 1 and 2, being guided around a drive roller, a freewheeling roller and an additional freewheeling roller, wherein an upper stringer of the belt forms a support area in the receiving arrangement.
Figure 4:
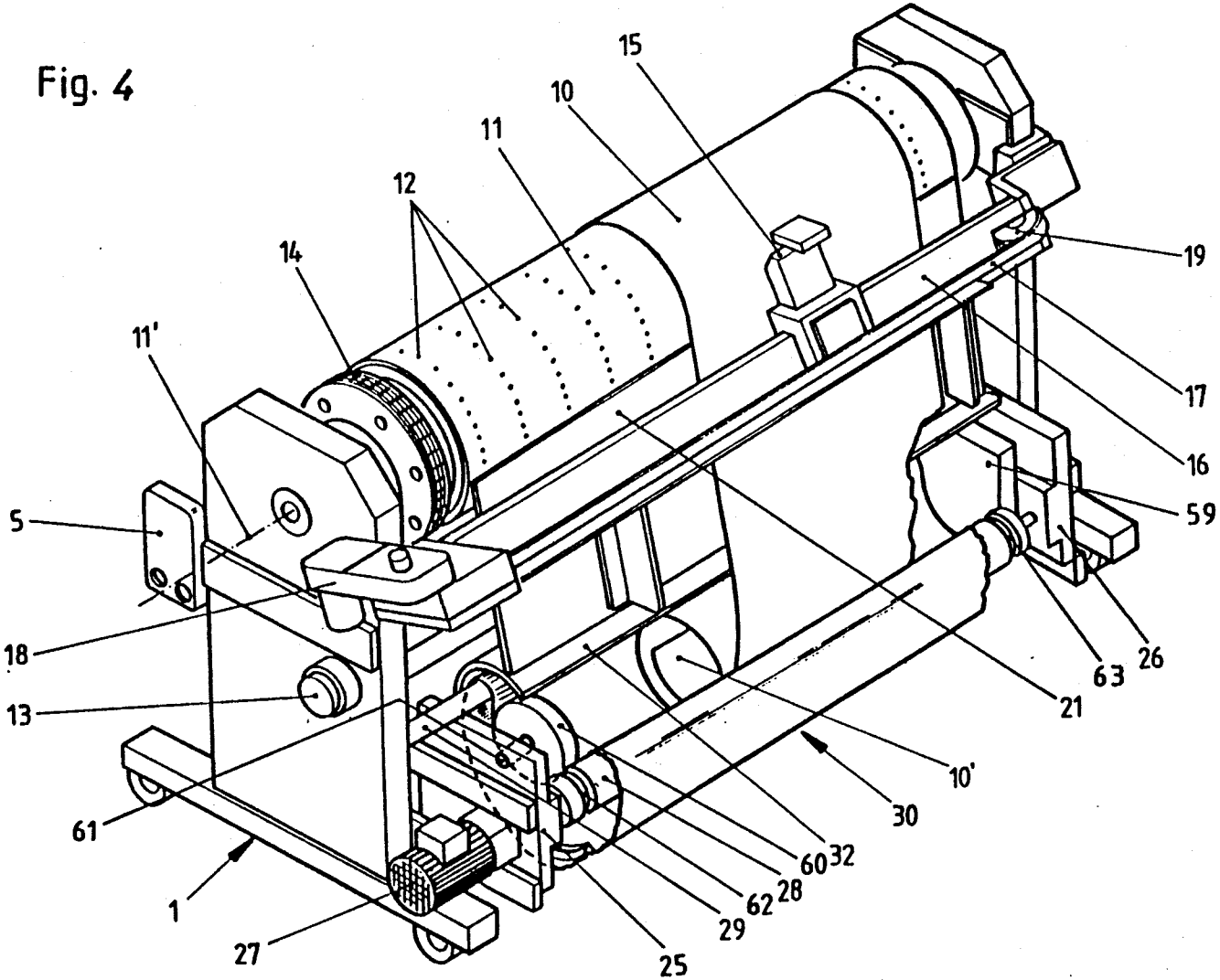
FIG. 4 shows, in an illustration corresponding to FIG. 2, a second fixture embodiment where the upper stringer of the endless belt is formed by circular disks.
Figure 5:
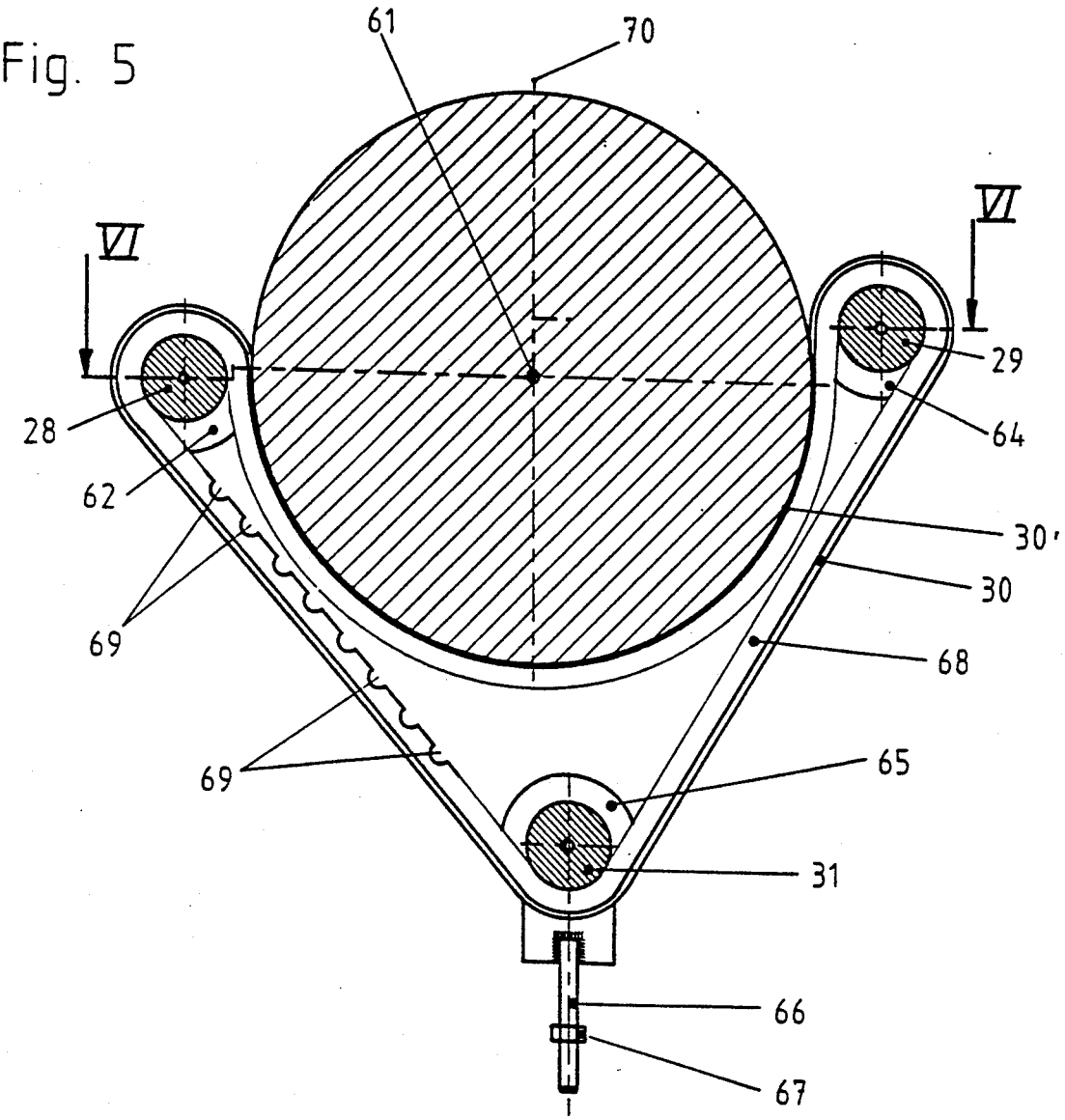
FIG. 5 is a vertical section through a circular disk as shown in FIG. 4, and the components adjacent to it.
Figure 6:
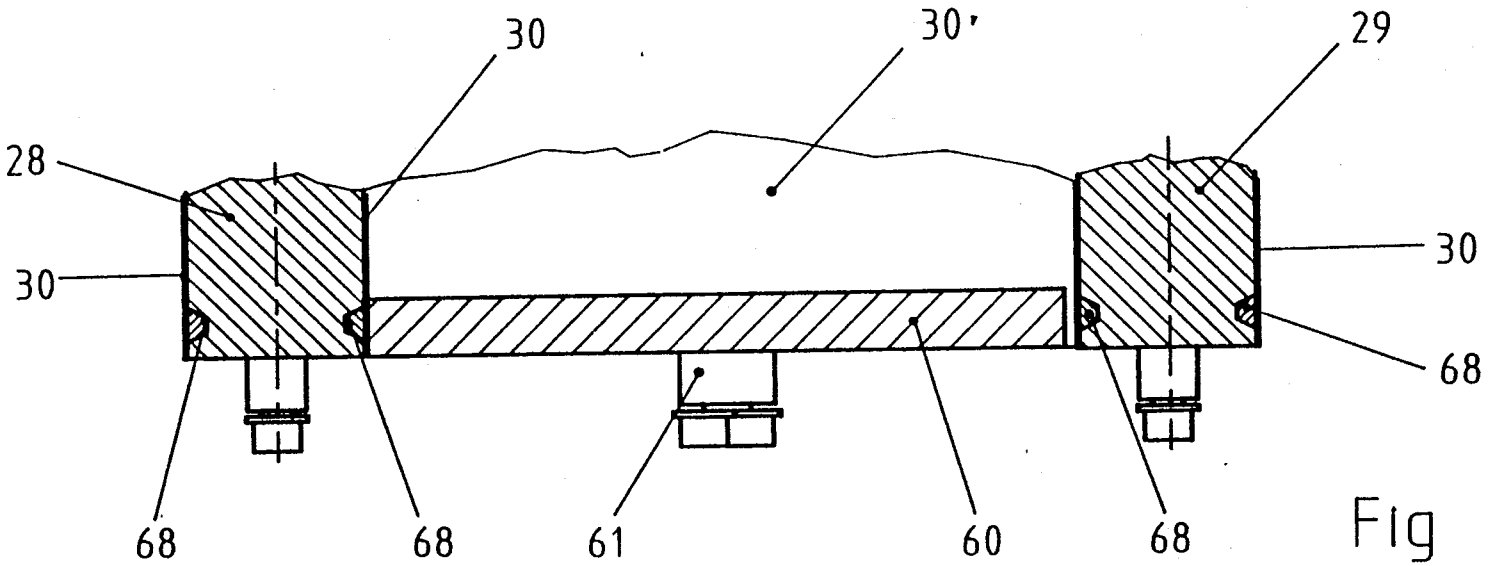
FIG. 6 is a partial section along the line VI—VI of FIG. 5.

The second embodiment fixture shown in FIGS. 4 to 6 corresponds in function and design to a large extent with the embodiment shown in FIGS. 1 to 3, and like parts have been given like reference numerals.

In contrast to the preferred embodiment shown in FIGS. 1 to 3, circular disks are provided in the embodiment according to FIGS. 4 to 6 in the area between the end sections of the driven roller 28 and the non-driven roller 29. Of these, only one circular disk 60 is shown in FIGS. 4 to 6. A circular disk shaped the same is at the other end of the drive roller 28 and the non-driven roller 29, but this disk is obscured by a cover 59. However, the two circular disks have the same functions and cooperate with like areas disposed at different ends of the drive roller 28 and the non-driven roller 29. For this reason, the function of both will be described only in connection with the circular disk 60.

The circular disk 60 is seated freely rotatable on a shaft 61, which is fixed in the block 25 and extends parallel to the axis of rotation of the drive roller 28. The shaft 61 is located in a vertical central plane 70 (FIG. 5), and the axes of rotation of the drive roller 28 and of the non-driven roller 29 are at the same distance from the shaft. As can be seen from FIG. 5, the circular disk 60 has such a diameter that it is in contact with the larger portion of the top surface of the upper stringer 30' of the endless belt 30. This contact is made on both sides up to a height which is somewhat above the horizontal plane in which the axis of rotation of the drive roller 28 is located. In this way, a shape in the form of an arc of a circle is imparted to the upper stringer, which corresponds to the arc of the circle of the circular disk 60. Additionally, the circular disk 60 presses the endless belt 30 against the drive roller 28 and the non-driven roller 29 in such a way that a greater wrap results (clearly visible in FIG. 5) than was the case in the first embodiment, shown in FIGS. 1 to 3.

As FIGS. 5 and 6 also show, the drive roller 28, the non-driven roller 29 and the additional freewheeling roller 31 have a circular groove 62 or 63, 64 and 65 in the plane of the circular disk 60. A V-belt-shaped rib 68 is provided in the plane of the circular disk 60 on the inside of the belt 30, i.e. on the side which comes into contact with the rollers 28, 29, 31. This rib is in engagement with the annular grooves 62, 64, 65 and contributes to guiding and positioning of the belt 30. Evenly spaced apart cut-outs 69 are provided in the free edge of the V-belt-shaped rib 68, (only partially shown in FIG. 5), and are distributed along the entire rib 68. The cut-outs 69 make possible a required deformation of the rib 68, when wrapping around the rollers 28, 29, 31.

A tensioning element 66 and a set screw 67 on the additional freewheeling roller 31, as shown in FIG. 5, help to perform a displacement, not shown, of the additional freewheeling roller 31, so that a desired tension of the belt 30 will be achieved.

While the present invention has been described with respect to what presently are considered to be the preferred embodiments, it is to be understood that the invention is not limited to the disclosed embodiments. To the contrary, the present invention is intended to cover various modifications and equivalent arrangements included with the spirit and scope of the appended claims. The following claims are to be accorded a broad interpretation, so as to encompass all such modifications and equivalent structures and functions.

We claim:

1. An apparatus for guiding a web of material across a driven drum to a receiving arrangement located lower than the drum, the receiving arrangement having at least one surface moving vertically to the axis of rotation of the drum so as to contact and take along a portion of the material web as it rolls off the drum, said apparatus comprising:

a driven drum that forms a processing surface;

a receiving arrangement formed by an upper concave portion of an endless belt (30) extending in a sagging loop between a drive roller (28) and a non-driven roller (29), the non-driven roller (29) being located at the back end of the upper concave portion (30'), looking in the direction of belt movement, whereby an engagement between the drive roller (28) and belt (30) is free of relative movement therebetween;

a stationary deflection surface positioned substantially across the drive roller in the direction of movement of the web, and disposed a distance above the non-driven roller; and, a planar circular disk, located between the drive roller and the non-driven roller at each end of the rollers and located substantially in a vertical plane between the drive roller and non-driven roller, each disk having an axis of rotation that extends parallel to the axis of rotation of the drive roller, in engagement with the upper surface of more than one half of said upper concave portion of the endless belt.

2. A fixture in accordance with claim 1, wherein the circular disk (60) is in contact with the upper concave portion (30') of the endless belt (30) along a circular arc from the drive roller (28) to the non-driven roller (29).

3. A fixture in accordance with claim 2, wherein the circular disk (60) presses the upper concave portion (30') of the endless belt (30) into engagement with the drive roller (28) and the non-driven roller (29).

4. A fixture in accordance with claim 3, wherein a guide rib (68) is provided on the surface of the endless belt (30) facing radially inward, the rib being in engagement with adapted grooves (62; 64) of the drive roller (28) and the non-driven roller (29).

5. A fixture in accordance with claim 2, wherein a guide rib (68) is provided on the surface of the endless belt (30) facing radially inward, the rib being in engagement with adapted grooves (62; 64) of the drive roller (28) and the non-driven roller (29).

6. A fixture in accordance with claim 1, wherein a guide rib (68) is provided on the surface of the endless belt (30) facing radially inward, the rib being in engagement with adapted grooves (62; 64) of the drive roller (28) and the non-driven roller (29).

7. A fixture in accordance with claim 6, wherein the guide rib of the endless belt (30) consists of a V-belt-shaped rib (68), with evenly spaced cut-outs (69) on the V-belt-shaped rib free edge.

* * * * *